US012397970B2

(12) United States Patent
McAtarian et al.

(10) Patent No.: US 12,397,970 B2
(45) Date of Patent: Aug. 26, 2025

(54) EQUIPMENT TRANSPORT BAG

(71) Applicant: Andax Industries, L.L.C., Saint Marys, KS (US)

(72) Inventors: Patrick F. McAtarian, St. Marys, KS (US); Mark McAtarian, St. Marys, KS (US)

(73) Assignee: Andax Industries, L.L.C., St. Marys, KS (US)

( * ) Notice: Subject to any disclaimer, the term of this patent is extended or adjusted under 35 U.S.C. 154(b) by 0 days.

(21) Appl. No.: 18/342,558

(22) Filed: Jun. 27, 2023

(65) Prior Publication Data

US 2023/0339656 A1 Oct. 26, 2023

Related U.S. Application Data

(63) Continuation of application No. 18/054,605, filed on Nov. 11, 2022, now Pat. No. 11,702,249, which is a continuation of application No. 16/026,942, filed on Jul. 3, 2018, now abandoned.

(51) Int. Cl.

| | |
|---|---|
| ***B65D 33/06*** | (2006.01) |
| ***B65D 33/02*** | (2006.01) |
| ***B65D 85/30*** | (2006.01) |

(52) U.S. Cl.

CPC ..... *B65D 33/06* (2013.01); *B65D 33/02* (2013.01); *B65D 85/30* (2013.01)

(58) Field of Classification Search

CPC ..... B65D 33/06; B65D 33/02; B65D 85/30
USPC ..... 206/701, 720; 383/6, 15, 16, 17, 18, 24, 383/28; 294/68.1, 68.3; 220/475
See application file for complete search history.

(56) References Cited

U.S. PATENT DOCUMENTS

| | | | | |
|---|---|---|---|---|
| 5,865,541 | A * | 2/1999 | Lafleur | B65D 88/1618 383/122 |
| 6,079,934 | A * | 6/2000 | Beale | B65D 90/046 383/117 |
| 6,155,772 | A * | 12/2000 | Beale | B65D 90/205 383/117 |
| 7,500,786 | B2 * | 3/2009 | Richardson, Jr. | B65D 88/1618 220/495.08 |
| 8,777,001 | B1 * | 7/2014 | Bennett | B65D 85/00 206/204 |
| 2002/0038745 | A1 * | 4/2002 | Lamming | A45C 3/001 190/125 |
| 2007/0127852 | A1 * | 6/2007 | Town | B65D 88/1618 383/18 |
| 2012/0155787 | A1 * | 6/2012 | Powell | B65D 90/24 383/25 |

* cited by examiner

*Primary Examiner* — Jacob K Ackun
(74) *Attorney, Agent, or Firm* — Hovey Williams LLP

(57) ABSTRACT

Equipment transport bag assemblies (20, 92, 98, 145, 152, 182) each including an upright, open-top, equipment-receiving bag (22, 110, 158) with associated equipment-handling assemblies (24, 92, 102, 164, 184). The assemblies (24, 92, 102, 164, 184) have load-bearing strap units (34, 114, 166, 186) operably associated with the transport bags (22, 110, 158) so that the strap units (34, 114, 166, 186) bear the primary loads during lifting and handling of the bag assemblies (20, 92, 98, 145, 152, 182).

16 Claims, 7 Drawing Sheets

EQUIPMENT TRANSPORT BAG

CROSS REFERENCE TO RELATED APPLICATION

The present application is a continuation of U.S. patent application Ser. No. 18/054,605, filed Nov. 11, 2022, which is a continuation of U.S. patent application Ser. No. 16/026,942, filed Jul. 3, 2018, the entire disclosure of each which is hereby incorporated by reference herein.

BACKGROUND OF THE INVENTION

Field of the Invention

The present invention is concerned with equipment containment bag assemblies designed to provide environmentally safe shipping and storage conditions for leaking or otherwise non-performing equipment, such as pole-mounted distribution transformers, switchgear, breakers, and reclosers, equipped with lifting appendages (e.g., lifting lugs, eyes, or hooks). More particularly, the invention is concerned with such bag assemblies having an open-top equipment-receiving bag with an equipment-handling assembly associated with the bag and including at least one load-bearing strap unit designed to engage the at least one lifting appendage, and interconnected bag-supporting sections. In this way, the load-bearing strap units bear the primary loads associated with lifting and handling of equipment within the bag.

Description of the Prior Art

Conventional electrical transformers used in power distribution systems include a sealed, oil-filled tank with internal electrical components, such as transformer coils. These transformers also have external hardware, such as mounting equipment, connection busses, and lifting lugs. These transformers are subject to leaking over time, resulting from damage to the transformer tank or from extended use. Such leakages can be environmentally damaging, inasmuch as the oil formulations within the transformers can often include hazardous chemicals (e.g., PCBs). In any event, it is necessary to safely transport failed transformers for disposal or repair, in accordance with governmental regulations. In like manner, other types of equipment, and especially electrical utility equipment, require safe and effective containment and shipping enclosures.

A number of different transformer containment devices have been provided in the past. For example, Andax Industries LLC has commercialized Xtra HD Pole-Mount Transformer Sac™ containment bags, which have large, puncture-proof transformer bags with opposed perforated sections which can be opened to allow access to transformer lifting lugs. However, these bags do not provide any closures for these openings, and accordingly moisture or contaminants can enter the bags.

U.S. Pat. No. 8,777,001 describes another type of transformer containment bag which includes a bag with an internal liner and external lifting hoops. These kinds of bags are deficient, and indeed do not meet relevant regulatory standards, because the lifting lugs of the transformers cannot be accessed, thus requiring that the transformers be elevated and moved using only the bag components, which places considerable stress on the overall assemblies.

SUMMARY OF THE INVENTION

The present invention overcomes the problems outlined above and provides equipment transport bag assemblies, which allow lifting and handling of equipment having one or more lifting appendages without imposing undue loads upon the equipment bags. To this end, the bag assemblies of the invention comprise an upright bag (which may be of any desired shape or size, such as circular or quadrate) including a bottom wall and upwardly extending sidewall structure, the bag presenting an open upper end and configured to receive equipment therein; an equipment-handling assembly is operably associated with the bag and equipment and includes at least one load-bearing strap unit for operably engaging the at least one lifting appendage, with associated structure engaging and supporting the bag so that the equipment is retained within the bag during handling thereof.

In certain embodiments where the equipment includes at least a pair of spaced lifting lugs, the equipment-handling assembly includes a pair of load-bearing strap units each having a first strap section with an arcuate portion configured to engage a corresponding lifting lug, and a second strap section with an arcuate lifting portion, the first and second strap sections operably connected together. Again, the equipment-handling assembly is operably coupled with the bag so that the equipment is retained within the bag during handling thereof. As used herein, "lifting lugs" or "lugs" refer to any type of integrated lifting point(s) associated with the equipment to allow safe lifting and handling thereof. The term "operably connected together" with respect to the strap sections and arcuate lifting sections refers to the fact that these sections may be configured using individual straps which are then interconnected, or from a single strap.

To this end, each of the first lug-engaging strap sections may be formed from a first strap of material having opposed ends, the opposed ends secured to the sidewall structure by stitching or any other suitable technique. Likewise, the second strap sections are formed from a second strap of material having opposed ends, the opposed ends of the second straps secured to the sidewall structure and to the first straps. The load-bearing strap sections may be formed as reverse loops or as bight sections.

In other embodiments where the equipment lifting appendage(s) comprise one or more lifting eyes, typically mounted at the top central region of the equipment. In such cases, the equipment-handling assembly is operably connected with the equipment and the bag and includes at least one load-bearing strap unit operably coupled with the lifting appendage; other structure may be used to secure the bag, such as a separate strap passing through the lifting eye.

Advantageously, in all of the embodiments, the equipment-handling assembly is designed so that the strap units bear a substantial portion of the lifting load, normally at least about 85% of the load of the equipment, and usually essentially 100% thereof. In this way, the bag is not unduly stressed during handling of the equipment, but rather primarily serves as a containment vessel, and bears only the load of its weight and that of any collected fluid therein.

BRIEF DESCRIPTION OF THE DRAWINGS

While the drawings do not necessarily provide exact dimensions or tolerances for the illustrated components or structures, FIGS. 1-13 are to scale with respect to the relationships between the components of the structures illustrated therein.

DETAILED DESCRIPTION OF THE PREFERRED EMBODIMENTS

Embodiments of FIGS. 1-11

These embodiments are particularly designed for use with equipment such as transformers, which are universally provided with a pair of opposed, side-mounted lifting lugs.

Figure 2:
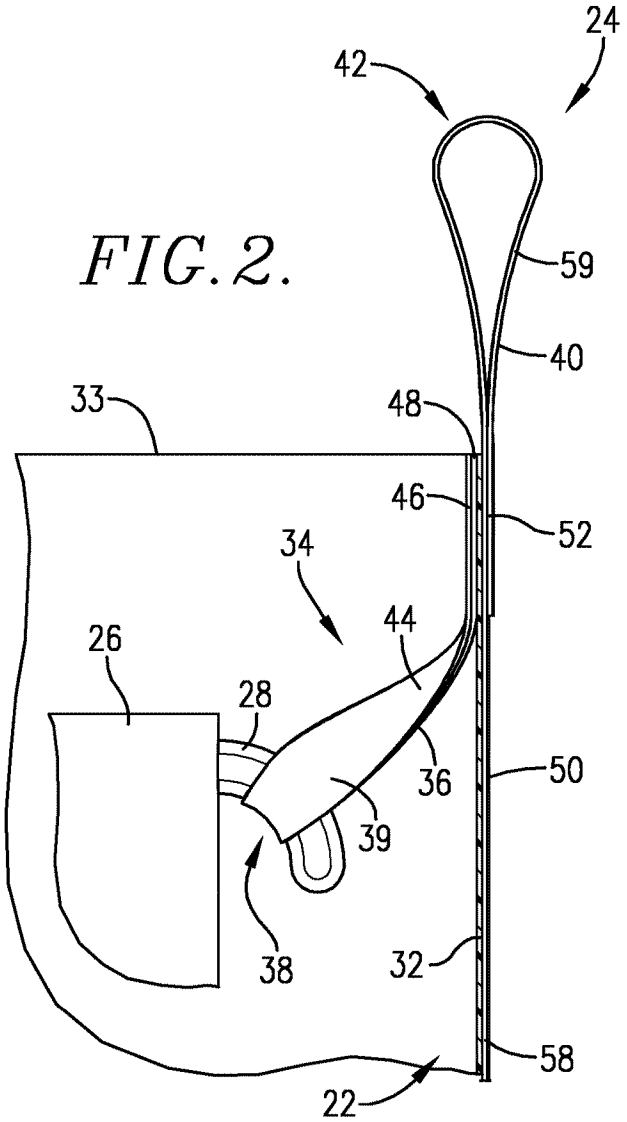
FIG. 2 is a fragmentary vertical sectional view illustrating one of the load-bearing strap units of the transport bag of FIG. 1.
Figure 1:
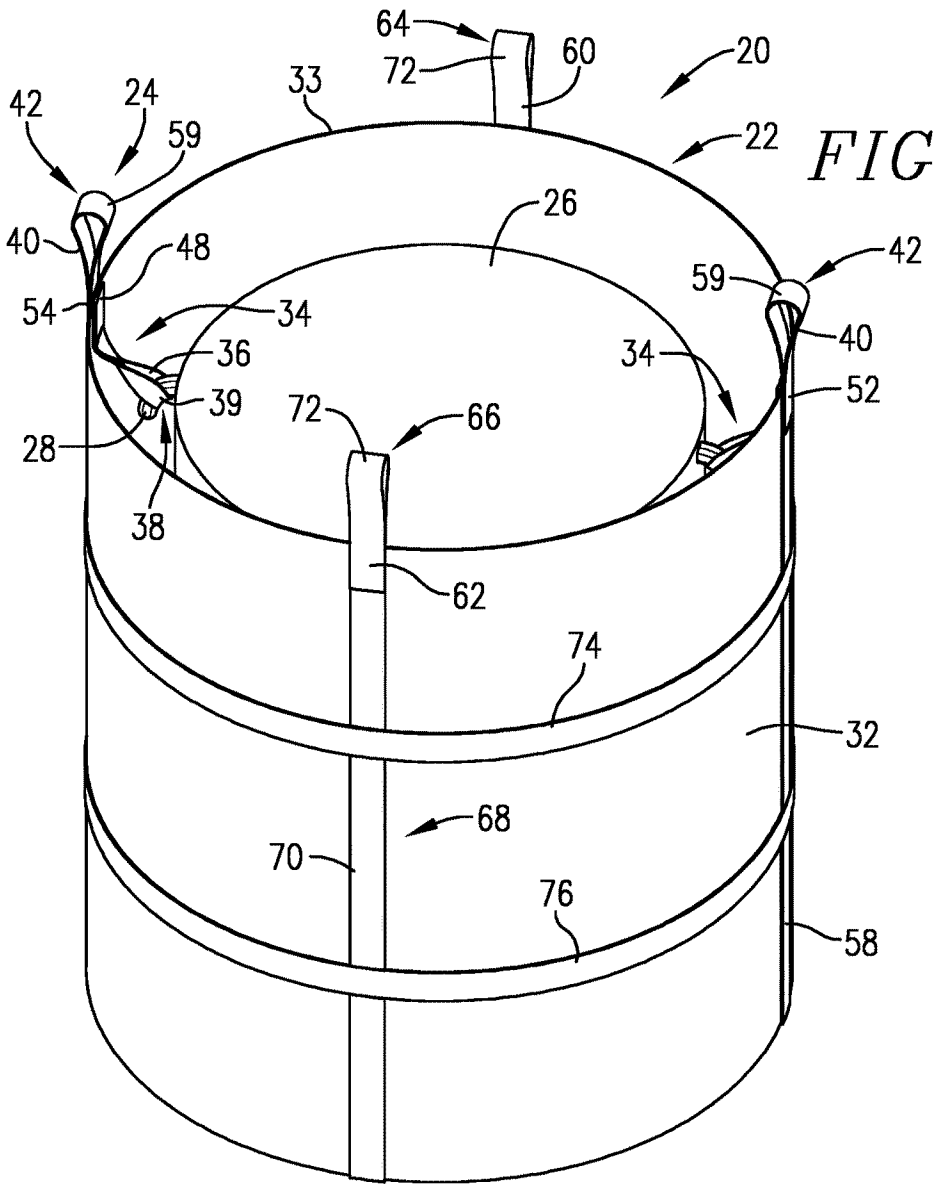
FIG. 1 is a perspective view of one embodiment of an equipment transport bag in accordance with the invention, shown with an electrical transformer within the bag, ready for lifting.
Figure 3:
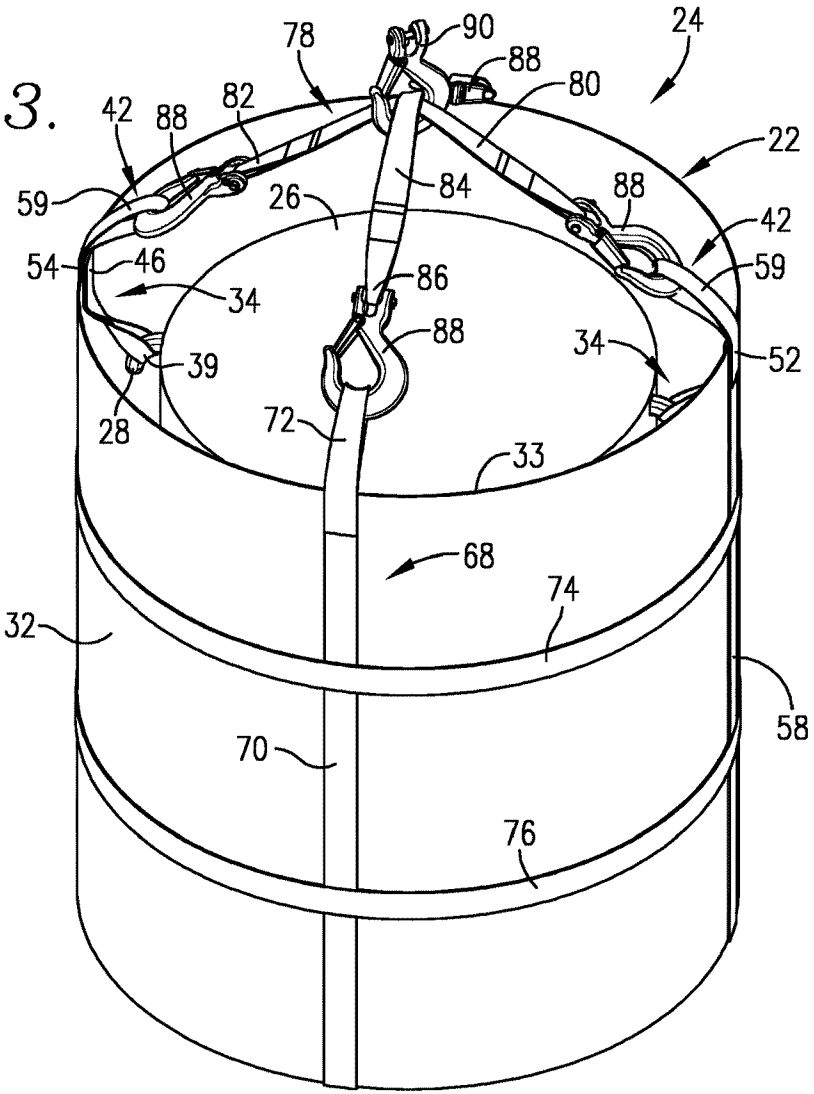
FIG. 3 is a perspective view similar to that of FIG. 1, but illustrating a lift assembly operably coupled with the equipment transport bag.
Figure 4:
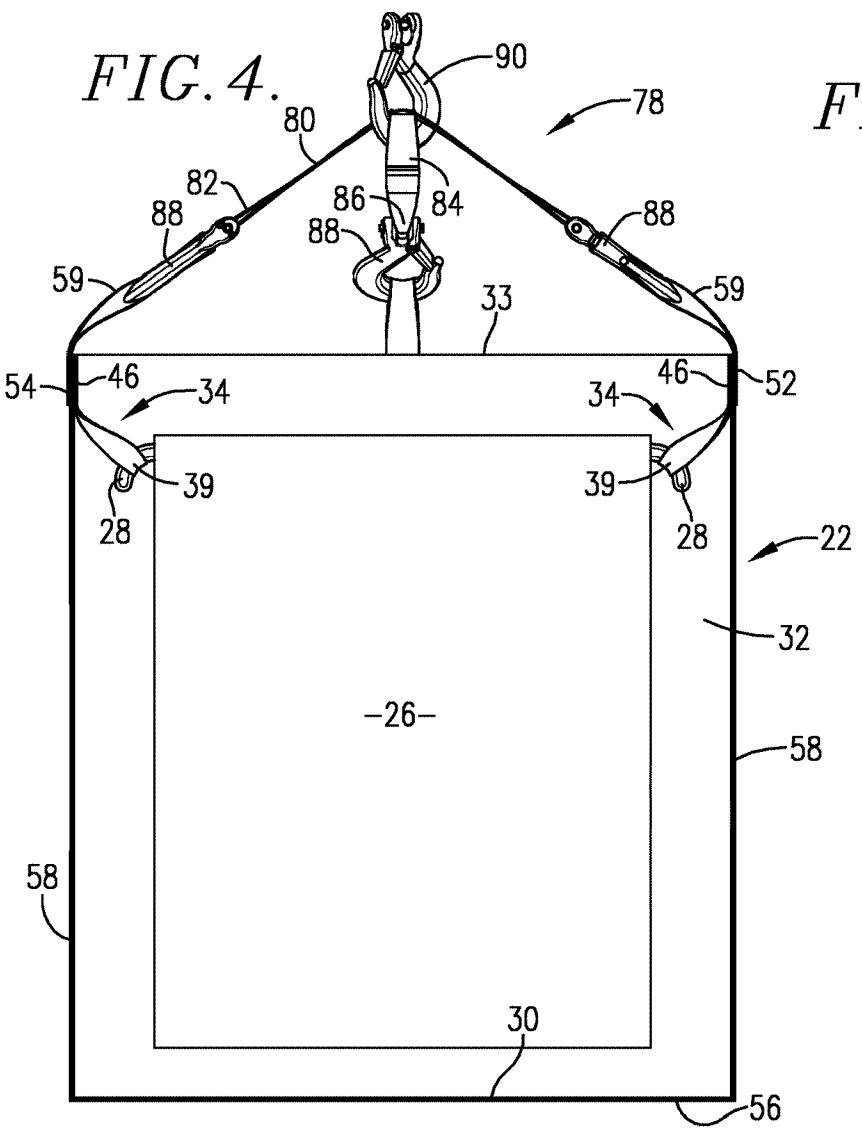
FIG. 4 is a vertical sectional view of the FIG. 1 embodiment, through the bag adjacent the central load-bearing straps, shown with the transformer supported by the load-bearing strap units.

Turning now to FIGS. 1-4, an equipment transport bag assembly 20 is depicted, which broadly includes an upright, open-top, generally circular in plan bag 22, together with an equipment-handling assembly 24. As illustrated, an electrical transformer 26 is received within bag 22, and has a pair of opposed, outwardly-extending lifting lugs 28 (FIGS. 2 and 4).

The bag 22 includes a bottom wall 30 and upwardly extending sidewall structure 32 terminating in an upper margin 33. The bag 22 may be fabricated from any suitable material, but is preferably formed of heavy-duty synthetic resin material, and is substantially leak-proof. As explained below, the function of bag 22 is primarily to contain any spillage of liquid from the transformer 26, and does not function as the primary load-bearing component during the lifting and handling of the transformer 26.

The assembly 24 includes a pair of opposed, load-bearing strap units 34, which, in this embodiment, are secured to the sidewall structure 32. Each such load-bearing strap unit 34 has a first section 36 with an arcuate portion 38 designed to engage a corresponding lifting lug 28, and a second strap section 40 with an arcuate lifting portion 42.

Each first strap section 36 is formed from an elongated first strap 44 having first and second ends 46 and 48. As illustrated, the ends 46, 48 terminate adjacent the upper margin 33 of sidewall structure 32, with the portion 38 being a loop 39 intermediate these ends. Each second strap section 40 is formed using a second, generally U-shaped strap 50 having opposed ends 52 and 54. The strap 50 presents a central bight 56 and upwardly extending, opposed legs 58. As shown, the bight 50 extends across bottom wall 30, whereas the legs 58 extend upwardly along the sidewall structure 32 to the upper margin 33; from this point, the legs 58 extend further upwardly and then downwardly to form each lifting portion 42 in the form of a loop 59. The bight 56 and legs 58 are secured to the bottom wall 30 and sidewall structure 32, respectively, by stitching or any other appropriate means.

The first and second strap sections 36 and 40 are secured to each other, and to sidewall structure 32 adjacent the upper margin 33. As illustrated in FIG. 2, the upper end of sidewall structure 32 is sandwiched between the ends 46, 48 of the first sections 36, and to the legs 58 and the terminal portions of the lifting portions 42. Such interconnections are preferably accomplished by means of stitching, but could be achieved by other means, such as by heat welding or suitable adhesive.

The overall equipment-handling assembly 24 also includes a pair of opposed, non-load-bearing, bag-orienting strap sections 60 and 62, each having a corresponding arcuate connection portion 64, 66. In this case, the strap sections 60, 62 are formed using a third U-shaped strap 68 presenting a central bight (not shown) and upstanding legs 70. The bight and legs 70 are secured to the bottom 30 of bag 22 and to the sidewall structure 32 thereof, respectively. The upper ends of each of the legs 70 extend above the margin 33 and are reversed to form loops 72. Again, the end portion of each loop 72 is secured to sidewall structure 32 by stitching or other appropriate means.

In order to provide further reinforcement for the bag 22, a pair of circumferentially extending upper and lower straps 74, 76 extend around sidewall structure 32 and the legs 58, and are secured thereto.

In order to effectively lift and transport the transformer 26 within the bag 22, an exemplary lift assembly 78 is employed (FIGS. 3-4). The assembly 78 includes a fourth strap 80 having endmost loops 82, as well as an identical fifth strap 84 with endmost loops 86. A clevis slip hook 88 is secured to each of the loops 82 and 86. As shown, the slip hooks 88 of strap 80 are secured to the loops 59, whereas the slip hooks 88 of strap 84 are secured to the loops 72. A single hook 90 engages the straps 80 and 84 at the central regions thereof, and is connected to a further lifting arrangement (not shown) to allow lifting and handling of bag 22 and the transformer 26 therein.

During such lifting and manipulation of bag 22, it will be appreciated that, owing to the construction of the strap units 34, these units and the associated lift assembly 78 bear a substantial part of the lifting load, and that the third strap 68, and the bag 22 itself, bear only a minor portion or none of the lifting load. In effect, the strap 68 and the associated loops 72 function primarily as a means of controlling the bag 22 during lifting and handling operations. For example, as set forth in FIG. 4, it will be observed that during lifting the transformer 26 is simply contained within bag 22 and does not engage the bag 22 at all. Thus, the strap units bear essentially all of the load of the equipment, while the bag 22 bears its own weight and any fluid collected therein.

Figure 6:
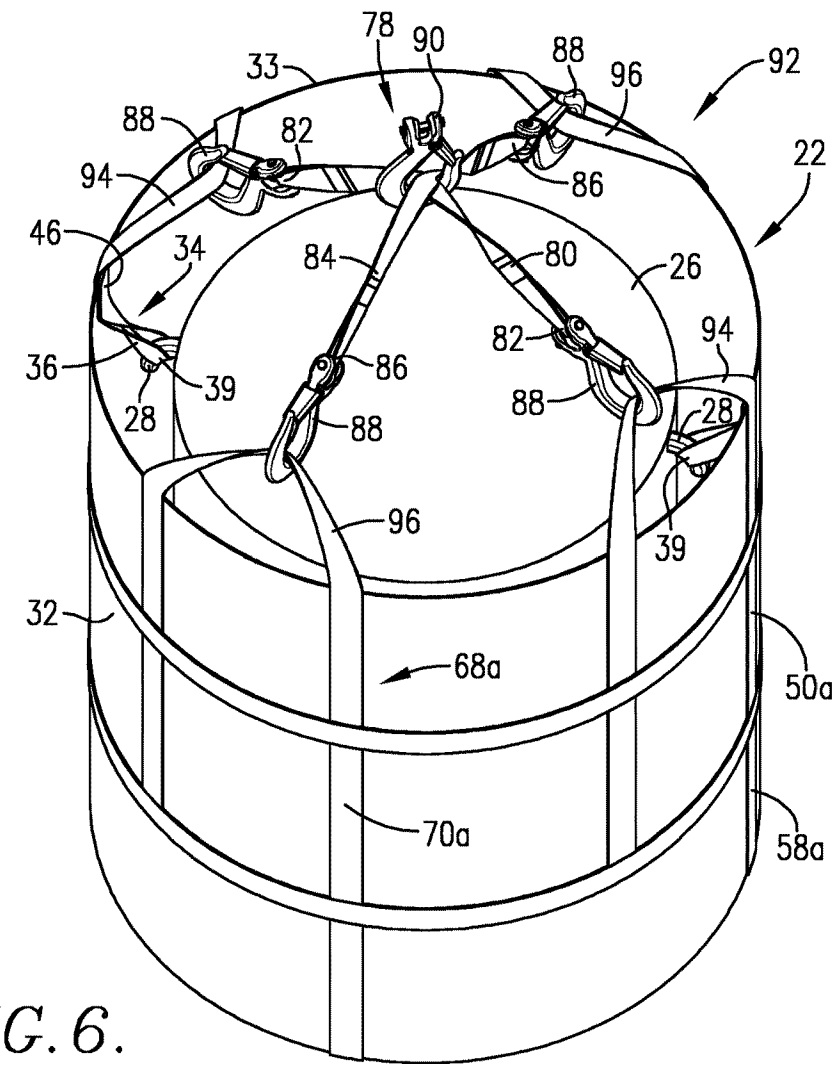
FIG. 6 is a view similar to that of FIG. 5, but depicting a lift assembly operably coupled with the transport bag.
Figure 5:
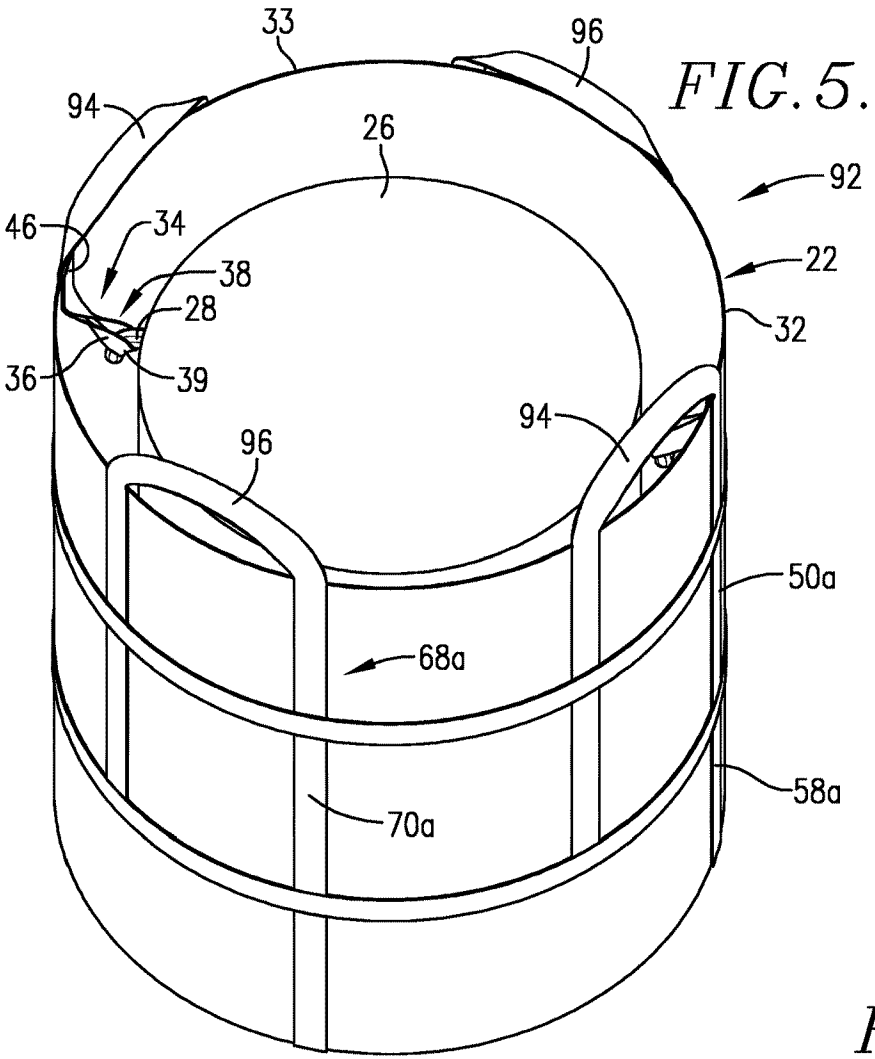
FIG. 5 is a perspective view of another equipment transport bag embodiment in accordance with the invention, illustrated with an electrical transformer therein.

FIGS. 5-6 illustrate another embodiment in accordance with the invention, which is similar in many respects to the embodiment of FIGS. 1-4. Accordingly, identical parts will be given the same reference numerals. The principal difference between the embodiment of FIGS. 5-6 and that of FIGS. 1-4 lies in the fact that, instead of the reverse loops 59 and 72, arcuate sections 94 and 96 are used. Thus, the second U-shaped strap 50*a* has legs 58*a* which extend upwardly along and are connected to the sidewall structure 32, but extend further upwardly and laterally to form the arcuate bight sections 94 and then extend downwardly along the sidewall structure 32 in spaced relationship to the legs 58*a*. Similarly, the upwardly extending legs 70*a* of third U-shaped strap 68*a* extend further above the margin 33 and then laterally to form bight sections 96, with the terminal portions of the strap 68*a* extending downwardly and connecting to sidewall structure 32 in spaced relationship to the legs 70*a*. In all other respects, the embodiment of FIGS. 5-6 is identical to that of FIGS. 1-4.

Figure 8:
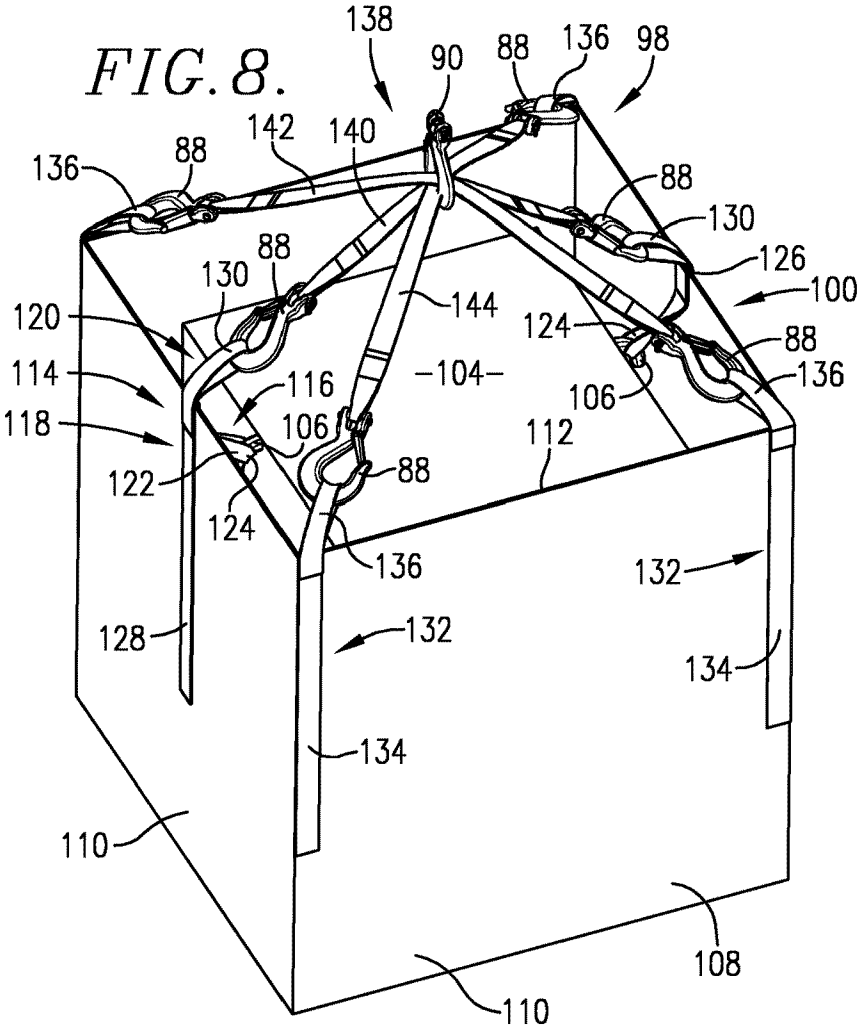
FIG. 8 is a view similar to that of FIG. 7, but depicting a lift assembly operably coupled with the transport bag.
Figure 7:
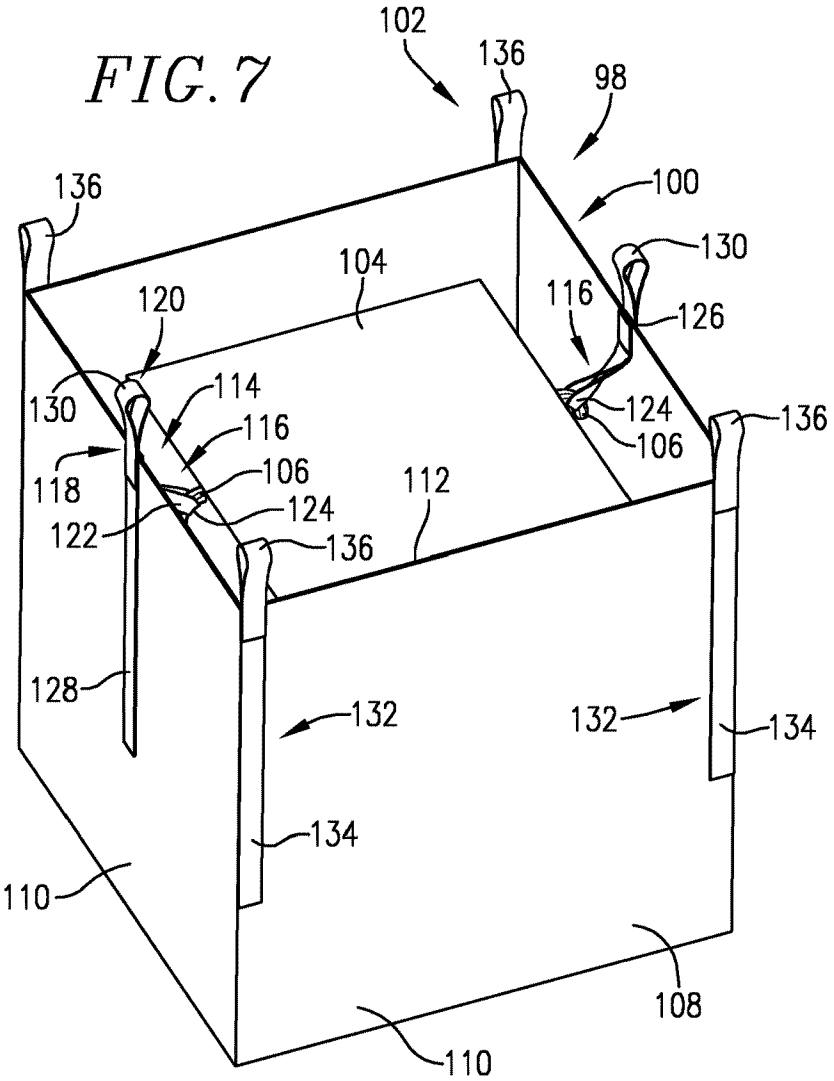
FIG. 7 is a perspective view of another equipment transport bag embodiment in accordance with the invention of quadrate configuration, illustrated with an electrical transformer therein.

FIGS. 7-8 depict a third embodiment in the form of a transport bag assembly 98 including an upright, open-top, substantially quadrate in plan bag 100, together with an equipment-handling assembly 102. Equipment 104 is received within bag 100, and is equipped with side-mounted lifting lugs 106.

The bag 100 includes a bottom wall (not shown) together with sidewall structure 108 in the form of four interconnected sidewall panels 110 cooperatively defining an upper margin 112. The bag 100 is flexible and is formed of appropriate synthetic resin or other suitable material.

The handling assembly 102 includes a pair of opposed, load-bearing strap units 114 secured to sidewall structure 108. Each such strap unit 114 has a first section 116 designed to engage a corresponding lifting lug 106, and a second strap section 118 with an arcuate lifting portion 120. Each of the strap sections 116 are very similar to the sections 36 described above, and include an elongated strap 122 having a loop 124 with the strap ends 126 secured to the inner face of sidewall structure 108 adjacent margin 112. Each strap section 118 is made up of an elongated strap 128 secured to the outer face of sidewall structure 108, with an extension above margin 112 in the form of a reverse loop 130. The strap sections 116 and 118 are secured to each other, and to bag sidewall structure 108 by stitching or any other appropriate means.

The handling assembly 102 also includes a total of four substantially non-load-bearing, bag-orienting strap sections 132 located at the corners of the bag. Each strap section 132 includes an elongated strap 134 secured to the exterior face of sidewall structure 108 and extending above margin 112 with a reverse loop 136. The end of loop section 136 is secured to the upper end of strap 134, and to sidewall structure 108.

A lift assembly 138 is provided for lifting and handling of the bag 100 with equipment 104 therein. The assembly 138 is very similar to that of previously described assembly 78, and includes a lift strap 140 having slip hooks 88 secured to the ends thereof and coupled with the loops 130. Additionally, two other straps 142 and 144 are provided, each having endmost slip hooks 88, and designed to couple with the corner loops 136.

Figure 10:
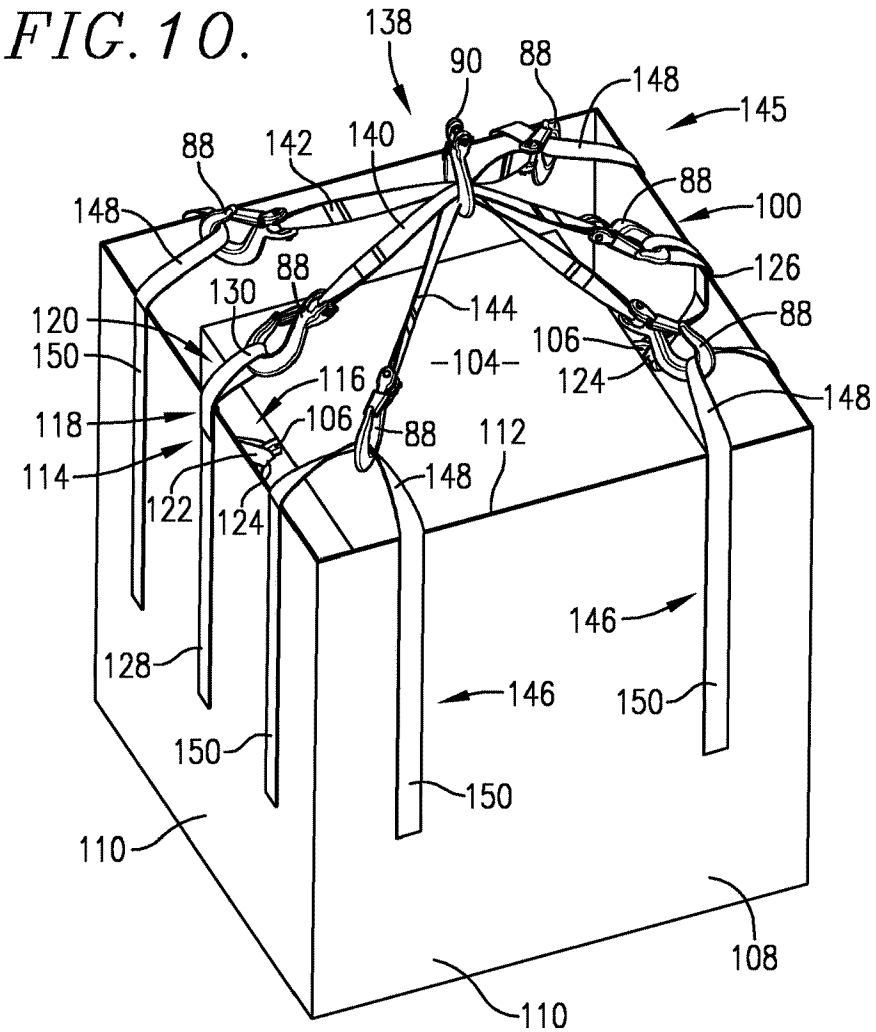
FIG. 10 is a view similar to that of FIG. 9, but depicting a lift assembly operably coupled with the transport bag.
Figure 9:
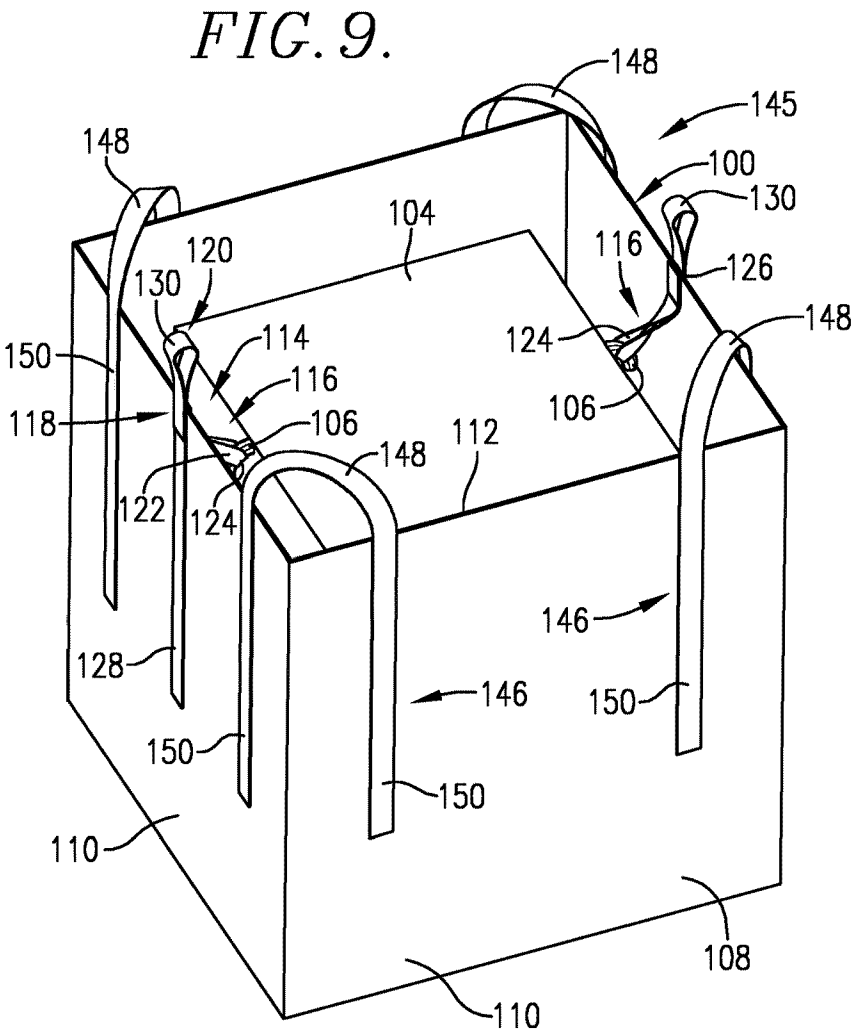
FIG. 9 is a perspective view of another equipment transport bag embodiment in accordance with the invention of quadrate configuration, illustrated with an electrical transformer therein.
Figure 11:
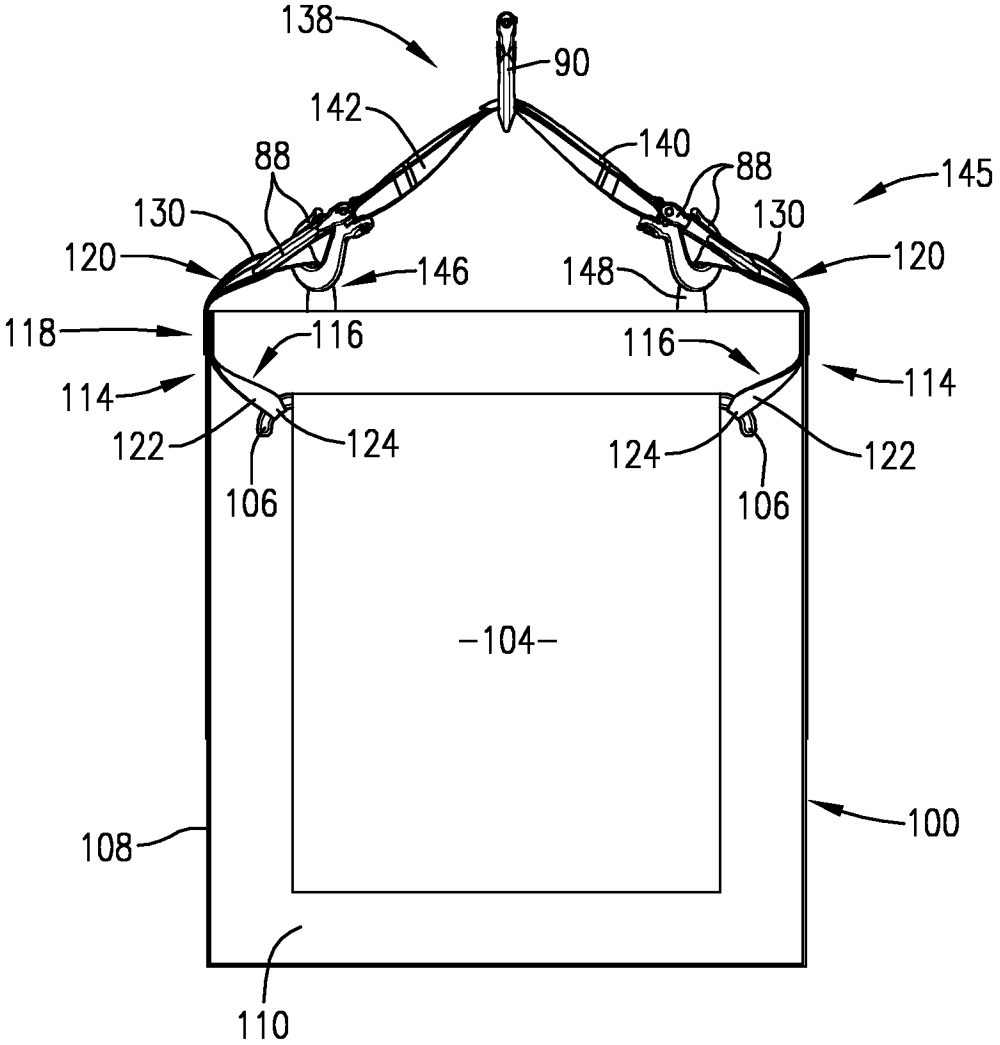
FIG. 11 is a vertical sectional view of the FIG. 7 embodiment, through the bag adjacent the central load-bearing straps, shown with the transformer supported by the load-bearing strap units.

FIGS. 9-11 illustrate a still further embodiment of the invention in the form of a bag assembly 145, which is very similar to that of FIGS. 7-8, and again, like components are identified by the same reference numerals. The only difference between the embodiment of FIGS. 9-11 versus that of FIGS. 7-8 lies in the non-load-bearing corner straps. In FIGS. 9-10, a continuous, generally U-shaped strap 146 is provided adjacent each corner of the bag 100. The straps 146 include an uppermost bight 148 and two downwardly extending legs 150. The latter are secured to the outer faces of the adjacent sidewall panels 110, as illustrated. Likewise, the lift assembly 138 differs only in the connection of the straps 142 and 144 to the bights 148, rather than the loops 136.

Just as in the earlier embodiments, the strap units 114 serve as the primary load-bearing structure, so that the equipment 104 is separate from the bag 100 when elevated.

Each of the embodiments illustrated in FIGS. 1-11 make use of load-bearing strap units having first and second strap sections which are interconnected and secured to the equipment-receiving bag. It should be understood, however, that the invention is not limited to these types of constructions. For example, the load-bearing strap units can be formed from a single strap, which may be connected to the bag or pass through a slit or other opening in the bag sidewall, without any direct connection between the bag and the strap units. In the latter case, the bag is lifted with the single strap units and is retained in place by the latter and the bag-orienting strap sections.

Figure 13:
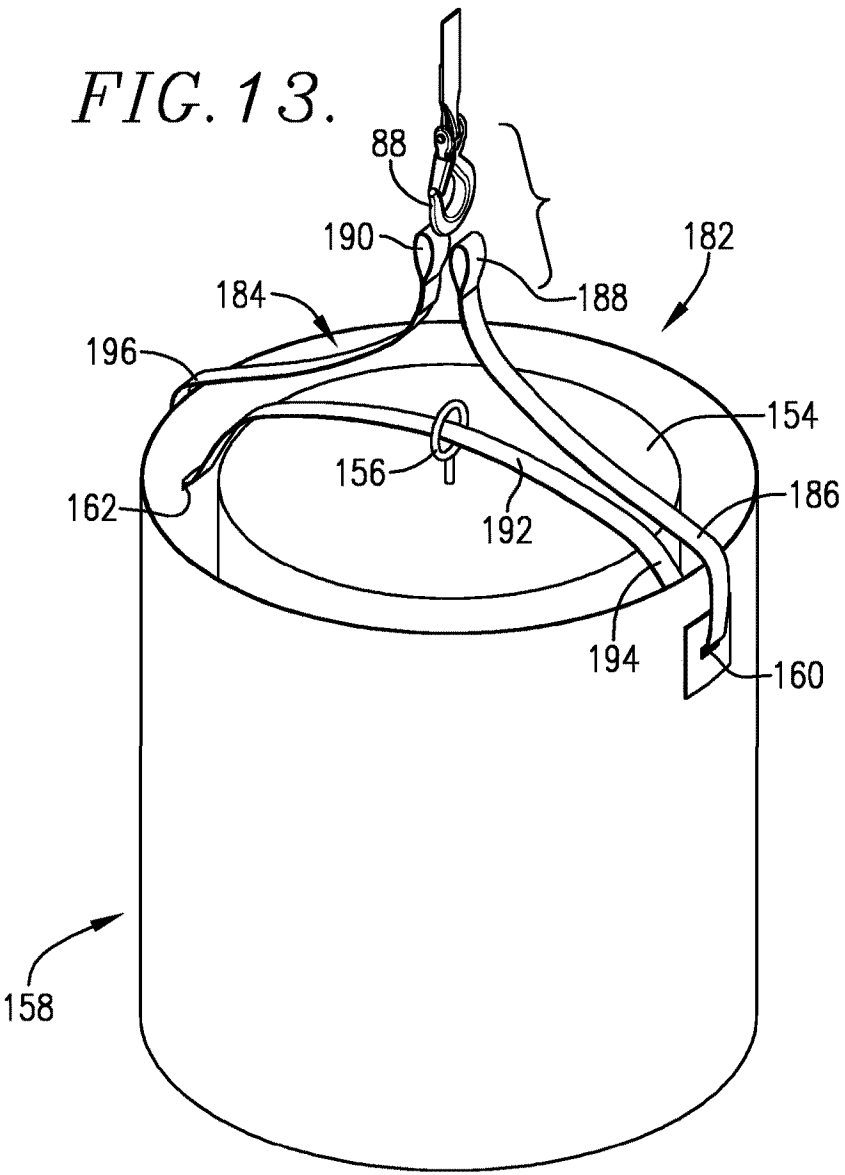
FIG. 13 is another embodiment wherein the lifting appendage is in the form of a central lifting eye, and wherein the equipment handling assembly comprises a single strap having a first portion engaging the lifting eye, second lifting portions respectively passing through openings formed in the bag sidewall, and third lifting portions.
Figure 12:
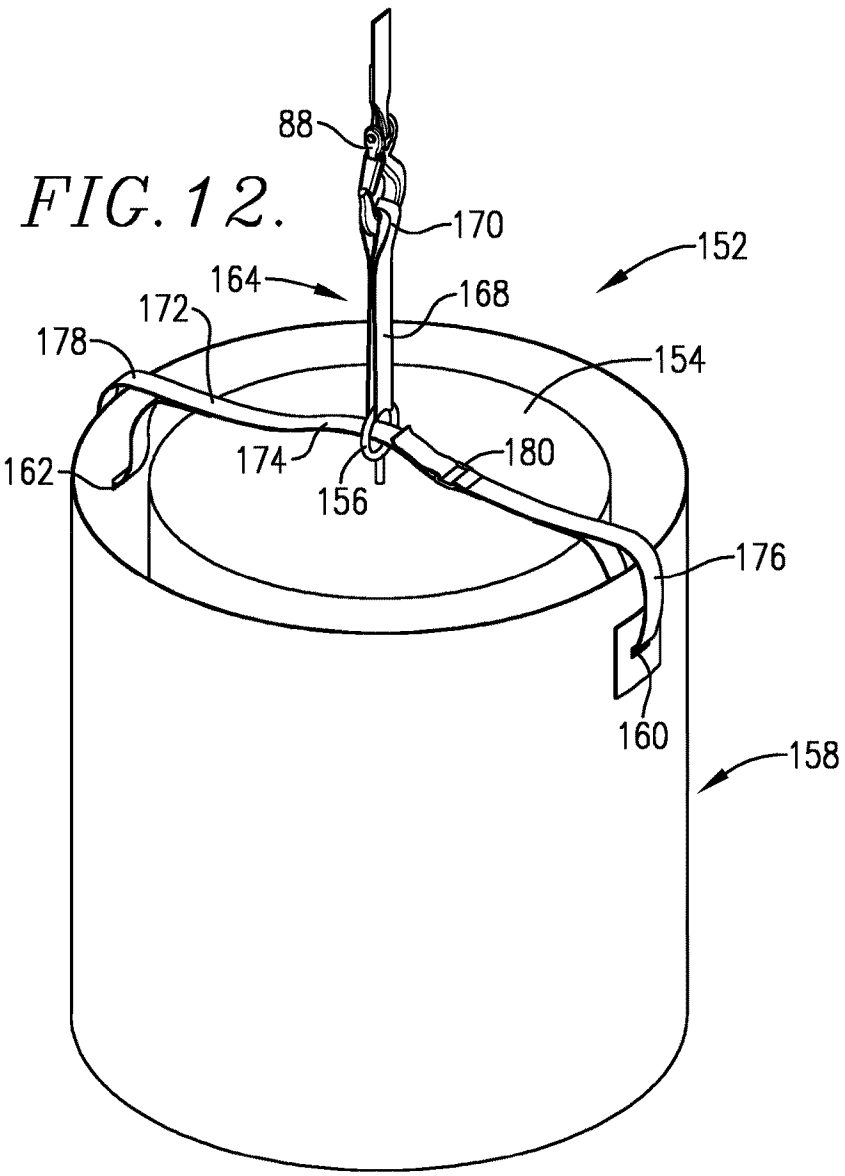
FIG. 12 is a perspective view of another embodiment wherein the lifting appendage is in the form of a central lifting eye, and wherein the equipment handling assembly comprises a pair of strap units.

Embodiments of FIGS. 12 and 13

These embodiments are especially designed for use with equipment having a central, top-mounted lifting eye, in lieu of or in addition to side-mounted lifting lugs.

FIG. 12 illustrates an equipment transport bag assembly 152, which is useful in connection with equipment 154 having an upstanding, central lifting eye 156. As in the case of the earlier embodiments, the assembly 152 has a bag 158, here equipped with a pair of opposed, reinforced opening slits 160, 162 in the sidewall of the bag. The assembly 152 also has an equipment-handling assembly 164 in the form of a first generally U-shaped load-bearing strap unit 166, which has a lower segment 168 engaging the eye 156, and upper loop sections 170 each designed to receive a slip hook 88. The overall assembly 164 also includes a bag-supporting strap 172 having a central section 174 passing through the eye 156, with outboard side loop sections 176, 178 passing through the corresponding opening slits 160, 162. One end of the strap 172 is equipped with a metallic ring 180, whereas the other end has opposed Velcro sections allowing passage through ring 180 and connection to itself.

As will be appreciated from this structure, essentially all of the lifting load is borne by the first strap 166, with the strap 172 supporting only the weight of the bag 158.

FIG. 13 depicts another equipment transport bag assembly 182 to be used with the equipment 154 having lifting eye 156. The assembly 182 is made up of the bag 158 as well as a modified equipment-handling assembly 184. The latter has a single strap unit 186 having terminal loops 188 and 190. As shown, the strap unit has a central section 192 which passes through eye 156, as well as outboard loops sections 194 and 196 respectively passing through the bag opening slits 160, 162. Finally, the strap 186 has third lifting portions in the form of the loops 188, 190. Both of these loops are designed to interfit with a slip hook 88. Again, it will be appreciated that essentially all of the lifting load is carried by the assembly 184, and little if any of such load is transferred to the bag 158.

We claim:

1. An apparatus for use with an equipment lift assembly, said apparatus comprising:

equipment including a lifting element; and an equipment transport bag assembly handling the equipment, said bag assembly including an upright bag defining an interior receiving the equipment therein, said bag including an opening slit, said bag assembly further including an equipment-handling assembly, said equipment-handling assembly including a strap unit, said strap unit including a first section located at least in part within the bag interior, with the first section engaging the lifting element of the equipment located within the bag interior, said strap unit including a second section extending through the opening slit, said equipment-handling assembly including a lifting portion located at least in part outside the bag interior and configured to operably couple with the equipment lift assembly, said lifting portion operably coupled to the second section of the strap unit, such that the equipment-handling assembly supports the equipment within the bag interior and functions as the primary load-bearing component of the equipment transport bag assembly during lifting and handling of the equipment using the equipment transport bag assembly.

2. The apparatus of claim 1, said opening slit being reinforced.

3. The apparatus of claim 2, said bag including a bottom wall and sidewall structure extending upwardly from the bottom wall, said opening slit being formed in the sidewall structure.

4. The apparatus of claim 1, said lifting portion and the second section of the strap unit being integrally formed by a single strap of material.

5. The apparatus of claim 1, said bag including a pair of opening slits, said strap unit including a pair of second sections, each extending through a corresponding one of the opening slits.

6. The apparatus of claim 5, said opening slits being diametrically opposed from one another.

7. The apparatus of claim 5, said equipment-handling assembly including a pair of lifting portions, each being operably coupled to a corresponding one of the second sections and each being configured to operably couple with the equipment lift assembly.

8. The apparatus of claim 7, each of said lifting portions and the corresponding one of the second sections being integrally formed by a single strap of material.

9. The apparatus of claim 8, said first section, second sections, and lifting portions being integrally formed by the single strap of material.

10. The apparatus of claim 8, said opening slits being reinforced.

11. The apparatus of claim 8, said bag including a bottom wall and sidewall structure extending upwardly from the bottom wall, said opening slits being formed in the sidewall structure.

12. The apparatus of claim 11, said opening slits being diametrically opposed from one another.

13. The apparatus of claim 5, said first section and said second sections being integrally formed by a single strap of material.

14. The apparatus of claim 13, said equipment-handling assembly including a pair of lifting portions, each being operably coupled to a corresponding one of the second sections and each being configured to operably couple with the equipment lift assembly.

15. The apparatus of claim 14, said lifting portions being integrally formed by a second single strap of material.

16. The apparatus of claim 15, each of said straps of material engaging the lifting element of when the equipment located within the bag interior.

* * * * *